US009184570B2

(12) United States Patent
Murayama et al.

(10) Patent No.: US 9,184,570 B2
(45) Date of Patent: Nov. 10, 2015

(54) SPARK PLUG FOR INTERNAL COMBUSTION ENGINE OF MOTOR VEHICLES

(71) Applicants: DENSO CORPORATION, Kariya-city, Aichi-ken (JP); ISHIFUKU METAL INDUSTRY CO., LTD., Soka-shi, Saitama (JP)

(72) Inventors: Yuki Murayama, Toyoake (JP); Nobuo Abe, Yokkaichi (JP); Yoshinori Doi, Soka (JP); Toshiyuki Tomine, Soka (JP); Shunsuke Yokota, Soka (JP)

(73) Assignees: DENSO CORPORATION, Kariya (JP); ISHIFUKU METAL INDUSTRY CO., LTD., Soka (JP)

( * ) Notice: Subject to any disclaimer, the term of this patent is extended or adjusted under 35 U.S.C. 154(b) by 0 days.

(21) Appl. No.: 13/969,868

(22) Filed: Aug. 19, 2013

(65) Prior Publication Data

US 2014/0049151 A1 Feb. 20, 2014

(30) Foreign Application Priority Data

Aug. 20, 2012 (JP) ..... 2012-181583
Mar. 22, 2013 (JP) ..... 2013-059611

(51) Int. Cl.
*H01T 13/20* (2006.01)
*H01T 13/39* (2006.01)

(52) U.S. Cl.
CPC ..... *H01T 13/39* (2013.01)

(58) Field of Classification Search
CPC ..... H01T 13/39
USPC ..... 313/140, 141, 143
See application file for complete search history.

(56) References Cited

U.S. PATENT DOCUMENTS

| | | | | |
|---|---|---|---|---|
| 5,578,894 | A | 11/1996 | Oshima | |
| 5,811,915 | A * | 9/1998 | Abe et al. | 313/141 |
| 5,869,921 | A | 2/1999 | Matsutani et al. | |
| 6,078,129 | A | 6/2000 | Gotou et al. | |
| 6,094,000 | A | 7/2000 | Osamura et al. | |
| 6,262,522 | B1 | 7/2001 | Osamura et al. | |
| 6,628,051 | B1 | 9/2003 | Menken et al. | |
| 6,846,214 | B1 | 1/2005 | Gotou et al. | |

(Continued)

FOREIGN PATENT DOCUMENTS

| | | |
|---|---|---|
| CN | 1610199 | 4/2005 |
| JP | 54-62923 | 5/1979 |

(Continued)

OTHER PUBLICATIONS

Office Action (6 pages) dated Jan. 20, 2015, issued in corresponding Chinese Application No. 201310363324.7 and English translation (4 pages).

*Primary Examiner* — Joseph L Williams
(74) *Attorney, Agent, or Firm* — Nixon & Vanderhye P.C.

(57) ABSTRACT

A spark plug has a center electrode and an earth electrode. The center electrode is faced to the earth electrode so that a spark discharging gap is formed between the center electrode and the earth electrode. An electrode chip is formed on at least one of the center electrode and the earth electrode. The electrode chip has a composition containing 40 to 60 mol % of aluminum and iridium as a remainder thereof. In the composition of the electrode chip, it is possible to replace part of the iridium with 1 to 20 mol % of at least one metal selected from nickel, iron, cobalt, platinum and rhodium.

12 Claims, 5 Drawing Sheets

(56) References Cited

U.S. PATENT DOCUMENTS

| | | | |
|---|---|---|---|
| 2003/0085644 | A1 | 5/2003 | Sugiyama et al. |
| 2004/0013560 | A1 | 1/2004 | Hrastnik |
| 2005/0110381 | A1 | 5/2005 | Kanao |
| 2009/0009048 | A1 | 1/2009 | Yoshimoto et al. |
| 2011/0198983 | A1 | 8/2011 | Manhardt et al. |
| 2013/0009538 | A1 | 1/2013 | Yoshimoto et al. |

FOREIGN PATENT DOCUMENTS

| | | |
|---|---|---|
| JP | 3-211248 | 9/1991 |
| JP | 5-343157 | 12/1993 |
| JP | 7-37672 | 2/1995 |
| JP | 7-37678 | 2/1995 |
| JP | 7-180836 | 7/1995 |
| JP | 7-235364 | 9/1995 |
| JP | 9-7733 | 1/1997 |
| JP | 9-298083 | 11/1997 |
| JP | 11-3765 | 1/1999 |
| JP | 2001-118660 | 4/2001 |
| JP | 2001-203060 | 7/2001 |
| JP | 2003-506835 | 2/2003 |
| JP | 2003-142225 | 5/2003 |
| JP | 2003-142226 | 5/2003 |
| JP | 2004-011024 | 1/2004 |
| JP | 2006-173141 | 6/2006 |
| JP | 2009-16278 | 1/2009 |
| JP | 2009-531541 | 9/2009 |
| JP | 2009-245640 | 10/2009 |
| JP | 2010-108939 | 5/2010 |
| JP | 2010-138418 | 6/2010 |
| JP | 2010-275575 | 12/2010 |
| JP | 2011-018612 | 1/2011 |
| JP | 2011-228250 | 11/2011 |

* cited by examiner

SPARK PLUG FOR INTERNAL COMBUSTION ENGINE OF MOTOR VEHICLES

CROSS-REFERENCE TO RELATED APPLICATION

This application is related to and claims priority from Japanese Patent Applications No. 2012-181583 filed on Aug. 20, 2012 and No. 2013-59611 filed on Mar. 22, 2013, the contents of which are hereby incorporated by reference.

BACKGROUND OF THE INVENTION

1. Field of the Invention

The present invention relates to spark plugs for use in internal combustion engines of motor vehicles.

2. Description of the Related Art

Internal combustion engines mounted to motor vehicles use various types of spark plugs in order to ignite a fuel in a combustion chamber. For example, a spark plug has a conventional structure in which a spark discharging gap is formed between a center electrode and an earth electrode. Spark discharge is generated in the spark discharging gap formed between the center electrode and the earth electrode in order to ignite a mixture gas composed of air and a fuel in the combustion chamber of the internal combustion engine. There is another type of a spark plug having a structure in which an electrode chip is formed on the center electrode or the earth electrode in order to increase an ignition capability, etc.

Recently, there is a demand for improving a wear resistance of an electrode chip used in a spark plug in view of a temperature increase in a combustion chamber of an internal combustion engine because the internal combustion engine has a high performance, etc. There are spark abrasion or spark wear and oxidation abrasion or oxidation wear which abrades an electrode chip in a spark plug. In the spark abrasion, a surface of the electrode chip is instantaneously melted by the spark discharge. On the other hand, in an occurrence of oxidation abrasion, a surface of an electrode is oxidized and vapored when the spark plug is used in a high temperature environment. For example, a Japanese patent laid open publication No. JP H09-298083 has disclosed a spark plug having a conventional structure in which an electrode chip is made of iridium Ir having a high melting point and a superior spark abrasion resistance capability. In addition to iridium, the electrode chip contains platinum Pt and rhodium Rh having a superior oxidation resistance.

However, because the conventional electrode chip used in the spark plug disclosed in JP H09-298083 is made of noble metals such as iridium, platinum and rhodium, this increases a manufacturing cost of the electrode chip and the spark plug. So, there is a demand for providing a spark plug having a superior spark discharging wear resistance capability, a superior oxidation resistance and a long life with a low manufacturing cost.

SUMMARY

It is therefore desired to provide a spark plug having a superior spark discharging wear resistance, a superior oxidation resistance and a long life with a low manufacturing cost.

An exemplary embodiment provides a spark plug having a center electrode and an earth electrode. In the spark plug, the earth electrode is arranged, which is faced to the center electrode so that a spark discharging gap is formed between the center electrode and the earth electrode. An electrode chip is formed on at least one of the center electrode and the earth electrode. In particular, the electrode chip contains 40 to 60 mol % of aluminum Al and iridium Ir as a remainder thereof.

In a structure of the spark plug according to an exemplary embodiment, the electrode chip is formed on at least one of the center electrode and the earth electrode. The electrode chip contains 40 to 60 mol % of aluminum and iridium as a remainder thereof. That is, the electrode chip in the spark plug is made of an alloy which contains aluminum and iridium (Ir—Al alloy). In particular, because the content of aluminum in the electrode chip is within a range of 40 to 60 mol % of the entire composition of the electrode chip, intermetallic compound Ir—Al is present as a main phase in the Ir—Al alloy.

The intermetallic compound Ir—Al in the Ir—Al alloy in the electrode chip has a high melting point and a superior oxidation resistance. That is, the intermetallic compound Ir—Al in the Ir—Al alloy has the superior spark wear resistance of iridium having a high melting point and superior oxidation resistance of aluminum. This makes it possible to provide the spark plug having superior spark wear resistance, superior oxidation resistance and a long life.

Further, because the electrode chip in the spark plug contains 40 to 60 mol % of aluminum which is not a noble metal and is available on the commercial market at a low cost. This makes it possible to decrease the manufacturing cost of the spark plug as well as the electrode chips when compared with a conventional spark plug having an electrode chip which is comprised of noble metals only such as platinum Pt, rhodium Rh in addition to iridium which are available on the commercial market at a high cost.

The present invention provides the electrode chip and the spark plug having the superior spark wear resistance, superior oxidation resistance and a long life.

BRIEF DESCRIPTION OF THE DRAWINGS

A preferred, non-limiting embodiment of the present invention will be described by way of example with reference to the accompanying drawings, in which.

DETAILED DESCRIPTION OF THE PREFERRED EMBODIMENTS

Figure 1:
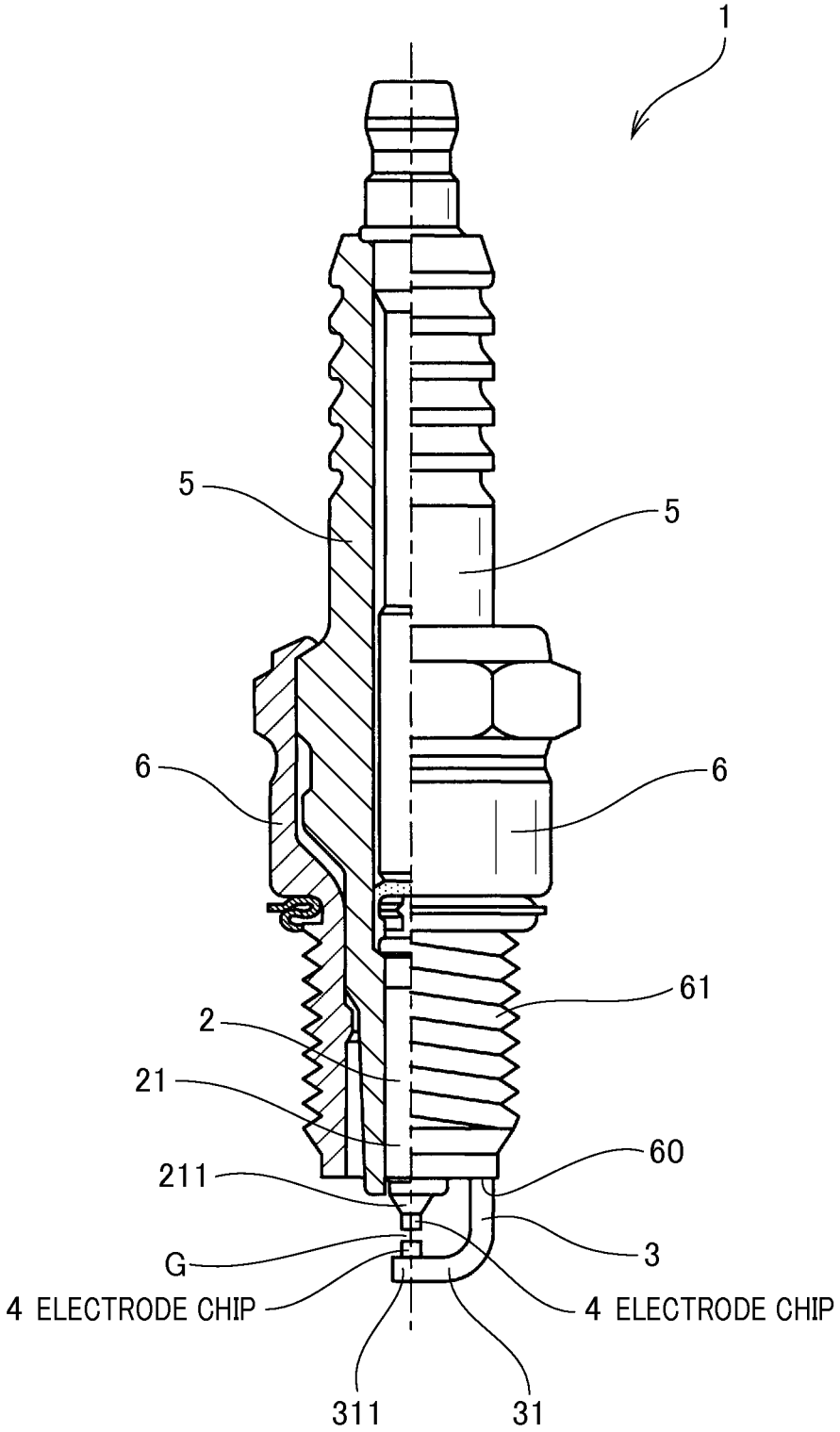
FIG. 1 is a view showing a cross section of a part of a spark plug according to first and second exemplary embodiments of the present invention.

Hereinafter, various embodiments of the present invention will be described with reference to the accompanying drawings. In the following description of the various embodiments, like reference characters or numerals designate like or equivalent component parts throughout the several diagrams.

The spark plug according to the present invention has one or more electrode chips. Each electrode chip comprises 40 to 60 mol % of a total of aluminum Al and iridium Ir as a remainder thereof. It is acceptable for each electrode chip to further comprise not more than 0.5 mol % of a total of silicon Si and zinc Zn as incidental impurity.

In general, iridium has a melting point of approximately 2447° C. On the other hand, aluminum has a melting point of approximately 660° C. which is lower than the melting point of iridium. Accordingly, the melting point of the electrode chip can be changed by adjusting a content of aluminum in the electrode chip. In addition, an oxidation resistance of the electrode chip can be changed by adjusting the content of aluminum.

For example, when a content of aluminum in an electrode chip formed in a spark plug is less than 40 mol %, it is possible to suppress a decrease of a melting point of the electrode chip, but there is a possibility of it being difficult to maintain a necessary oxidation resistance.

On the other hand, when a content of aluminum in an electrode chip formed in a spark plug is more than 60 mol %, it is possible to increase the oxidation resistance, but decrease a melting point of the electrode chip. In this structure, there is a possibility of it being difficult to maintain a necessary spark wear resistance.

In addition, when a content of aluminum in an electrode chip formed in a spark plug is less than 40 mol % and more than 60 mol %, there is a possibility of decreasing a ratio in a content of intermetallic compound Ir—Al in Ir—Al alloy in the electrode chip. That is, for example there is a possibility of increasing a content of solid solution of iridium and aluminum as a phase other than the intermetallic compound Ir—Al. This has a possibility of it being difficult for the electrode chip to maintain both the spark ware resistance capability and the oxidation resistance.

Further, there is an intermetallic compound Ir—Al as a main phase of Ir—Al alloy main phase which forms the electrode chip. Still further, a solid solution of iridium and aluminum as a phase other than Ir—Al alloy is often contained in the electrode chip.

Still further, it is possible to photograph a cross section of the electrode chip by using an optical microscope or an electron microscope, and to calculate a ratio of an area of the intermetallic compound Ir—Al in the entire area of the cross section of the electrode chip in order to obtain the ratio of the intermetallic compound Ir—Al in the Ir—Al alloy.

Still further, it is possible for the electrode chip to contain at least one metal selected from nickel Ni, iron Fe, cobalt Co, platinum Pt and rhodium Rh within a range of 1 to 20 mol %, which replaces part of the iridium in the electrode chip.

In this case, the electrode chip in the spark plug according to the present invention is made of an alloy (Ir—Al-M alloy) in which part of the Ir—Al alloy having a body centered cubic lattice structure (BCC structure) as a crystal structure is replaced with at least one element selected from nickel, iron, cobalt, platinum and rhodium. This one element will be referred with the reference character "the element M". The alloy forming the electrode chip contains the intermetallic compound Ir—Al-M comprised of iridium, aluminum and the element M as the main phase. This structure of the electrode chip makes it possible to suppress the generation of a phase such as a solid solution, etc. which is other than the intermetallic compound in the alloy which forms the electrode chip. Accordingly, it is possible to increase the ratio of the intermetallic compound in the alloy forming the electrode chip. This makes it possible to increase the spark wear resistance and the oxidation resistance of the electrode chip.

Still further, when a content of the element M, which replaces part of the iridium in the alloy forming the electrode chip, is less than 1 mol %, there is a possibility of suppressing the generation of a solid solution, etc. in the alloy forming the electrode chip, and of it being difficult to adequately obtain the effects to increase the ratio of the intermetallic compound in the alloy forming the electrode chip.

On the other hand, when the content of the element M is more than 20 mol %, because the content of iridium in the alloy forming the electrode chip is decreased and the melting point of the electrode chip is decreased, there is a possibility of it being difficult to adequately obtain the spark discharging wear resistance.

Still further, it is possible for the electrode chip according to the present invention to contain at least some nickel and rhodium instead of part of the iridium. This structure makes it possible to increase the ratio of the intermetallic compound in the alloy forming the electrode chip, and to further increase the spark wear resistance and the oxidation resistance of the electrode chip.

First Exemplary Embodiment

A description will be given of a spark plug 1 according to first and second exemplary embodiments to be used for internal combustion engines with reference to FIG. 1 and FIG. 2.

FIG. 1 is a view showing a cross section of a part of the spark plug 1 according to the first and second exemplary embodiments. FIG. 2 is a view showing a structure of a center electrode 2, an earth electrode 3, electrode chips 4 formed on the center electrode 2 and the earth electrode 4, and a spark discharging gap G in the spark plug according to the first and second exemplary embodiments shown in FIG. 1. In particular, the electrode chip 4 is formed on the center electrode 2. The electrode chip 4 is formed on the earth electrode 3. Those electrode chips 4 are faced to each other through the spark discharging gap G. The electrode chip 4 is made of 40 to 60 mol % of aluminum and iridium as a remainder thereof.

A description will now be given of a detailed structure of each electrode chip 4 in the spark plug 1 according to the first exemplary embodiment.

As shown in FIG. 1, the spark plug 1 is comprised of the center electrode 2, the earth electrode 3, the electrode chips 4, an electric insulator 5 such as a ceramic electric insulator, etc., and a housing case 6. The housing case 6 has a cylindrical shape. A screw section 61 is formed at the outer periphery of the housing case 6. The spark plug 1 is fixed to a wall section of a combustion chamber of an internal combustion engine (not shown) through a screw hole (not shown) formed in the wall section of the combustion chamber and the screw section 61 of the housing case 6.

The electric insulator 5 has a cylindrical shape. The electric insulator 5 is supported in the inside of the housing case 6. The center electrode 2 is supported in the inside of the electric insulator 5 so that the center electrode 2 is projected from the electric insulator 5 and exposed to the outside, i.e. a fuel mixture in the combustion chamber.

The earth electrode 3 is connected to a front end surface 60 of the housing case 6. As shown in FIG. 1 and FIG. 2, the earth electrode 3 extends from the front end surface 60 of the housing case 6 toward the center electrode 2, and is curved so that the earth electrode 3 is faced to the center electrode 2 along an axial direction of the spark plug 1.

Figure 2:
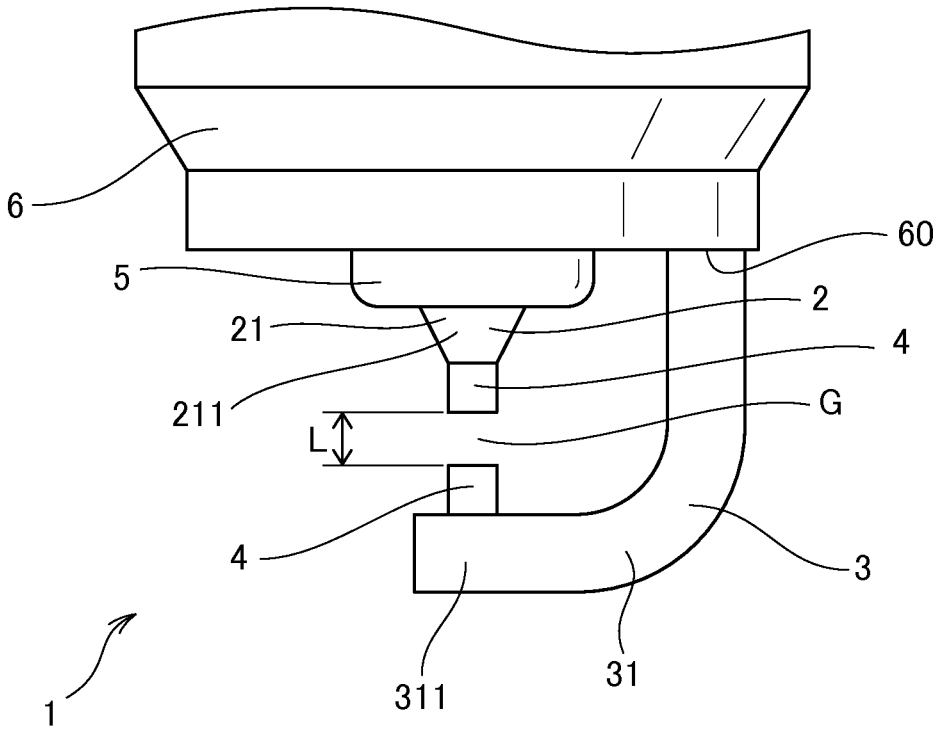
FIG. 2 is a view showing a structure of a center electrode, an earth electrode, an electrode chip formed on the center electrode, an electrode chip formed on the earth electrode and a spark discharging gap in the spark plug according to the first and second exemplary embodiments of the present invention shown in FIG. 1.

As shown in FIG. 2, the electrode chip 4 is connected to a front end section 21 of a center electrode base section 21 of the center electrode 2 by welding. In addition, the electrode chip 4 is connected to an opposition section 311 of an earth electrode base section 31 of the earth electrode 3 by welding. Each of the electrode chips has a cylindrical shape. The spark discharging gap G is formed between the electrode chips 4.

Each of the center electrode base section 21 of the center electrode 2 and the earth electrode base section 31 of the earth electrode 3 is made of nickel alloy (Ni alloy).

Each of the electrode chip 4 of the center electrode 2 and the electrode chip 4 of the earth electrode 3 is made of 40 to 60 mol % of aluminum, and iridium as a remainder thereof. That is, the electrode chip 4 is comprised of an alloy (Ir—Al alloy) comprised of iridium and aluminum. In addition to containing iridium and aluminum, it is acceptable for the electrode chip 4 to contain not more than approximately 0.5 mol % of a total of Si and Zn as incidental impurity.

A description will now be given of actions and effects of the spark plug 1 according to the first exemplary embodiment having the structure previously described.

In the structure of the spark plug 1 according to the first exemplary embodiment, the electrode chip 4 is formed on the center electrode 2 and the electrode chip 4 is also formed on the earth electrode 3. In particular, the electrode chip 4 has a specified composition, i.e., contains 40 to 60 mol % of aluminum and iridium as a remainder thereof.

Because the electrode chip 4 is comprised of an alloy (Ir—Al alloy) of iridium and aluminum, and the content of aluminum has the previously-described range, an intermetallic compound composed of iridium and aluminum (an intermetallic compound Ir—Al) is present as a main phase in the Ir—Al alloy which forms the electrode chip 4.

The intermetallic compound Ir—Al which is a main phase in the Ir—Al alloy has a high melting point and has a superior oxidation resistance. That is, the intermetallic compound Ir—Al contained in the electrode chip 4 has a high melting point and a superior spark wear resistance of iridium and a superior oxidation resistance of aluminum. This makes it possible to provide the spark plug 1 according to the first exemplary embodiment having both the superior spark wear resistance and the superior oxidation resistance. This makes it possible for the spark plug 1 to have a long life.

Further, the electrode chip 4 in the spark plug 1 according to the first exemplary embodiment contains 40 to 60 mol % of aluminum which is a low cost material and easily available in the commercial market by a low cost. This makes it possible to reduce the manufacturing cost of the electrode chips 4 in the spark plug 1. For example, the electrode chips 4 in the spark plug 1 according to the first exemplary embodiment can be produced with a low manufacturing cost when compared with the manufacturing cost of a conventional electrode chip which is made of noble metals such as iridium, platinum and Rhodium. That is, it is possible to manufacture the spark plug 1 having the electrode chips 4 according to the first exemplary embodiment with a low manufacturing cost.

As previously described, the first exemplary embodiment provides the spark plug 1, to be used for internal combustion engines, having a superior spark wear resistance, a superior oxidation resistance, and a long life.

Second Exemplary Embodiment

A description will be given of the spark plug 1 according to a second exemplary embodiment. Each of the center electrode 2 and the earth electrode 3 in the spark plug 1 according to the second exemplary embodiment has the electrode chip 4 which is different in content from the electrode chip 4 used in the spark plug 1 according to the first exemplary embodiment.

That is, the spark plug 1 according to the second exemplary embodiment has the electrode chips 4, each of which is comprised of at least one metal selected from nickel, iron, cobalt, platinum and rhodium within a range of 1 to 20 mol %. That is, the electrode chip 4 in the spark plug 1 according to the second exemplary embodiment is comprised of 40 to 60 mol % of aluminum, 1 to 20 mol % of at least one type of metals selected from nickel, iron, cobalt, platinum and rhodium. The electrode chip 4 is further comprised of iridium as a remainder thereof.

Because other components of the spark plug 1 according to the second exemplary embodiment are the same of those of the spark plug 1 according to the first exemplary embodiment, the explanation of those is omitted here.

In the second exemplary embodiment, the electrode chip 4 is comprised of an alloy (Ir—Al-M alloy) in which part of the Ir—Al alloy having a body centered cubic lattice structure (BCC structure) as a crystal structure is replaced with at least one element selected from nickel, iron, cobalt, platinum and rhodium. This one element will be referred with the reference character "the element M". The alloy forming the electrode chip 4 is comprised of the intermetallic compound Ir—Al-M. The intermetallic compound Ir—Al-M is comprised of iridium, aluminum and the element M. This structure of the electrode chip 4 in the spark plug 1 according to the second exemplary embodiment makes it possible to suppress the generation of a phase such as a solid solution, etc. which is other than the intermetallic compound in the alloy which forms the electrode chip 4. Accordingly, it is possible to increase the ratio of the intermetallic compound in the alloy forming the electrode chip 4. This makes it possible to increase the spark wear resistance and the oxidation resistance of the electrode chips. Other actions and effects of the spark plug according to the second exemplary embodiment are the same as those of the spark plug according to the first exemplary embodiment.

Third Exemplary Embodiment

A description will be given of a third exemplary embodiment. In the third exemplary embodiment evaluated the wear resistance of each of test samples as the spark plug. The wear resistance is composed of the spark discharging wear resistance and the oxidation resistance.

The third exemplary embodiment used a plurality of electrode chips having a different composition shown in Table 1. The third exemplary embodiment prepared test samples S1 to S21, each of which has an electrode chip having a different composition. The third exemplary embodiment detected the spark discharging wear resistance and the oxidation resistance of each of the test samples S1 to S21.

Further, Table 1 shows a composition, a ratio of an area of an intermetallic compound in the electrode chip in each of the test samples S1 to S21. Incidental impurity is omitted from Table 1.

A description will now be given of the electrode chip used in each of the test samples S1 to S21.

The electrode chip in each of the test samples S2 to S4 contained 40 to 60 mol % of aluminum, and iridium as a remainder thereof. That is, the electrode chip in each of the test samples S2 to S4 corresponds to the electrode chip 4 used in the spark plug 1 according to the first exemplary embodiment as previously described.

On the other hand, the electrode chip in the test sample S1 contained 70 mol % of aluminum which is more than 60 mol % of aluminum. The electrode chip in the test sample S5 contained 30 mol % of aluminum which is less than 40 mol % of aluminum.

The electrode chip in each of the test samples S2 to S4 contained 50 mol % of aluminum which is within a range of 40 to 60 mol % of aluminum, and 1 to 20 mol % of the element M which is at least one metal selected from nickel, iron, cobalt, platinum and rhodium, and iridium as a remainder thereof. In particular, part of the iridium is replaced with the element M in the electrode chip of each of the test samples S2 to S4. That is, the electrode chip in each of the test samples S2 to S4 corresponds to the electrode chip used in the spark plug according to the second exemplary embodiment as previously described.

On the other hand, the electrode chip in the test sample S9 contained 50 mol % of aluminum, and 30 mol % of nickel Ni which is more than 20 mol % of nickel Ni which replaces part of the iridium.

A description will now be given of a method of producing the electrode chip in each of the spark plugs as the test samples.

First of all, element powder such as iridium powder, aluminum powder, nickel Ni powder, iron Fe powder, cobalt Co powder, platinum Pt powder, rhodium Rh powder were mixed with a predetermined composition to make a raw mixture of the electrode chip.

Next, the raw mixture was melted over ten minutes by a plasma arc melting method using a maximum power of 7.5 kW, and dried to produce an ingot. The method used iridium powder of not less than 99.95% purity, platinum powder of not less than 99.95% purity, and rhodium powder of not less than 99.95% purity, and aluminum powder of not less than 95% purity, and nickel powder of not less than 99.8% purity.

Next, the produced ingot was annealed at a temperature of 1400° C. and over 72 hours in Argon Ar atmosphere. After the annealing process, the ingot was cut into parts having a predetermined size (having a diameter of 0.55 mm and an axial length of 0.8 mm). This produced the electrode chips having a cylindrical shape having a diameter of 0.55 mm and a length of 0.8 mm.

Next, a description will now be given of a method of detecting a ratio of an area of an intermetallic compound contained in the electrode chip in each of the test samples.

First of all, the electrode chip was cut in order to make a cut surface. The cut surface was polished by buffing.

Next, the polished surface of the electrode chip was photographed by an optical microscope or an electron microscope. A data processing software was executed to process the photographed image data. In other words, a binarization of the photographed image data was executed in order to distinguish an intermetallic compound phase from a solid solution phase. The ratio of an area of the intermetallic compound phase was calculated.

Figure 3:
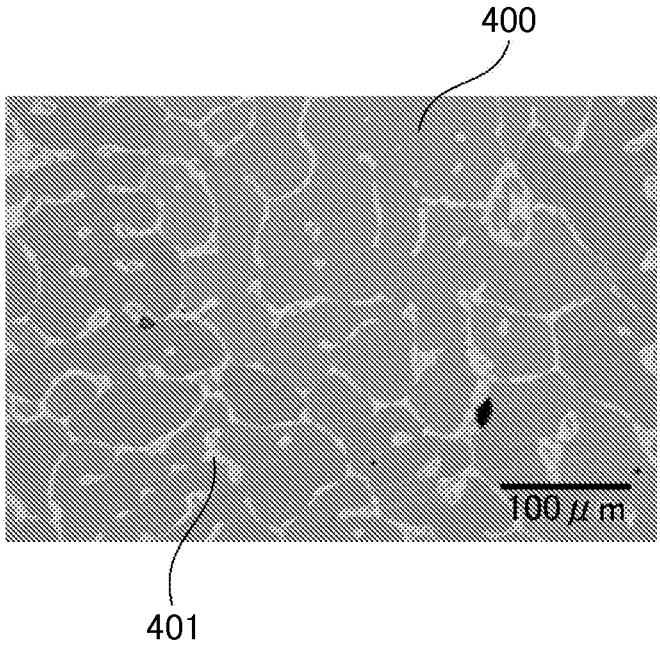
FIG. 3 is a view showing a cut surface of the electrode chip of the spark plug as a test sample S3 which corresponds to the first exemplary embodiment of the present invention.
Figure 4:
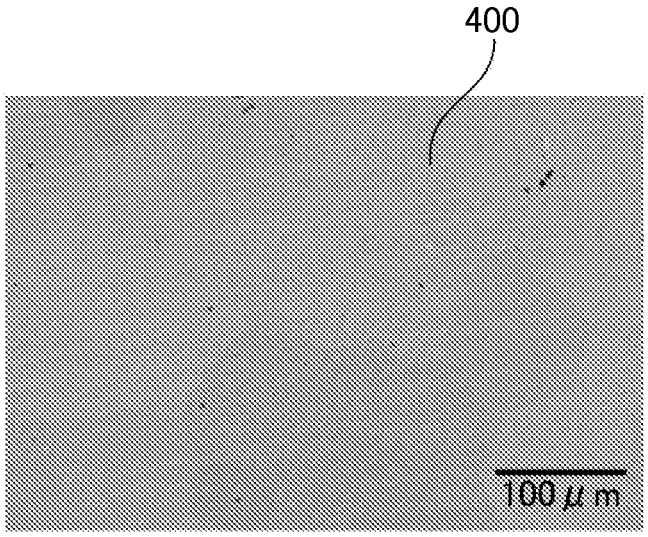
FIG. 4 is a view showing a cut surface of the electrode chip of the spark plug as a test sample S8 which corresponds to the second exemplary embodiment of the present invention.

FIG. 3 is a view showing a cut surface of the electrode chip of the spark plug as the test sample S3 which corresponds to the second exemplary embodiment which corresponds to the first exemplary embodiment. FIG. 4 is a view showing a cut surface of the electrode chip of the spark plug as the test sample S8 which corresponds to the second exemplary embodiment.

In FIG. 3 and FIG. 4, a gray area designated by reference number 400 indicates an intermetallic compound phase in the electrode chip, and a white area designated by reference number 401 indicates a solid solution phase in the electrode chip. As clearly shown in FIG. 4, there is an intermetallic compound phase only, and no solid solution in the cut surface of the electrode chip as the test sample S8.

A description will now be given of a wear resistance test.

Each electrode chip was fixed to each of the center electrode and the earth electrode in the spark plug as each of the test samples S1 to S21 by laser welding.

Next, the spark plug as each of the test samples S1 to S21 was mounted to an internal combustion engine with straight six cylinders having an engine displacement of 2500 cc.

Next, the internal combustion engine was running at 5600 rpm per minutes (full load condition) over 100 hours. A gap length L of the spark discharging gap G (see FIG. 2) in each of the test samples S1 to S21 was detected before and after the engine was running. When the detected gap length L was less than 0.03 mm, the evaluation result "A" was assigned to the test sample. On the other hand, when the detected gap length L was not less than 0.09 mm, the evaluation result "C" was assigned to the test sample. When the detected gap length L was within a range of not less than 0.03 mm and less than 0.09 mm, the evaluation result "B" was assigned to the test sample.

TABLE 1

| | Composition of electrode chip | | | | | | | Ratio (%) of area | | Evaluation result |
|---|---|---|---|---|---|---|---|---|---|---|
| Test samples | Ir | Al | Ni | Pt | Rh | Fe | Co | of intermetallic compound | Increased gap length (mm) | of wear resistance capability |
| | | | (*) Remainder | | | | | | | |
| S1 | * | 70 | | | | | | 40 | 0.11 | C |
| S2 | * | 60 | | | | | | 70 | 0.05 | B |
| S3 | * | 50 | | | | | | 95 | 0.04 | B |
| S4 | * | 40 | | | | | | 60 | 0.07 | B |
| S5 | * | 30 | | | | | | 25 | 0.14 | C |
| S6 | * | 50 | 1 | | | | | 100 | 0.02 | A |
| S7 | * | 50 | 10 | | | | | 100 | 0.02 | A |
| S8 | * | 50 | 20 | | | | | 100 | 0.02 | A |
| S9 | * | 50 | 30 | | | | | 100 | 0.09 | C |
| S10 | * | 50 | | 1 | | | | 100 | 0.03 | B |
| S11 | * | 50 | | 10 | | | | 100 | 0.04 | B |
| S12 | * | 50 | | 20 | | | | 100 | 0.05 | B |
| S13 | * | 50 | | | 1 | | | 100 | 0.01 | A |
| S14 | * | 50 | | | 10 | | | 100 | 0.01 | A |
| S15 | * | 50 | | | 20 | | | 100 | 0.02 | A |
| S16 | * | 50 | | | | 10 | | 100 | 0.05 | B |
| S17 | * | 50 | | | | | 10 | 100 | 0.06 | B |
| S18 | * | 50 | 10 | 10 | | | | 100 | 0.04 | B |
| S19 | * | 50 | 10 | | 10 | | | 100 | 0.02 | A |
| S20 | * | 50 | | 10 | 10 | | | 100 | 0.03 | B |
| S21 | * | 50 | 7 | 7 | 6 | | | 100 | 0.05 | B |

A description will now be given of the evaluation results of the wear resistance of each of the test samples S1 to S21.

As shown in Table 1, each of the test samples S2 to S4 containing 40 to 60 mol % of aluminum has the ratio of an area of an intermetallic compound of not less than 60%. Each of the test samples S2 to S4 has the evaluation result "B" of the wear resistance.

On the other hand, each of the test samples S1 and S5 containing 40 to 60 mol % of aluminum has the ratio of an area of an intermetallic compound of less than 60%. Each of the test samples S1 and S5 has the evaluation result "C" of the wear resistance.

As shown in Table 1, each of the test samples S6 to S8 and S10 to S21 containing 1 to 20 mol % of the element M, which replaces part of the iridium in the alloy, has the ratio of an area of an intermetallic compound of not less than 100%. That is, the alloy of each of the test samples S6 to S8 and s10 to S21 almost has an intermetallic compound phase, and does not have a solid solution phase. The test samples S2 to S4 have the evaluation result "A" or "B" of the wear resistance.

In particular, each of the test samples S6 to S8, S13 to S15, and S19 has the evaluation result "A" of the wear resistance, where part of the iridium is replaced with nickel Ni as the element M in the test samples S6 to S8, part of the iridium is replaced with rhodium Rh as the element M in the test samples S13 to S15, and part of the iridium is replaced with nickel Ni and rhodium Rh as the element M in the test sample S19.

On the other hand, the test sample S9 containing 1 to 20 mol % of the element M, which replaces part of the iridium in the alloy, has the ratio of an area of an intermetallic compound of less than 100%. However, the test sample S9 has the evaluation result "C" of the wear resistance.

As a result, it can be recognized that the spark plug according to the first exemplary embodiment, which corresponds to the test samples S2 to S4, has a high ratio of an area of the intermetallic compound (not less than 60%), and a superior wear resistance such as the spark discharging wear resistance and the oxidation resistance.

Further, it can also be recognized that the spark plug according to the second exemplary embodiment, which corresponds to the test samples S6 to S8 and S10 to S21, has a high ratio of an area of the intermetallic compound (100%), and a superior wear resistance such as a spark discharging wear resistance and the oxidation resistance. In particular, because part of the iridium is replaced with one or both of nickel Ni or rhodium Rh, the spark plug according to the second exemplary embodiment corresponding to each of the test samples S6 to S8 and S10 to S21 has superior wear resistance such as spark discharging wear resistance and the oxidation resistance. It is preferable for the electrode chip to have not more than 20 mol % of the element M which replaces part of the iridium.

Fourth Exemplary Embodiment

A description will now be given of an evaluation of the oxidation resistance of the spark plug with reference to FIG. 5.

Figure 5:
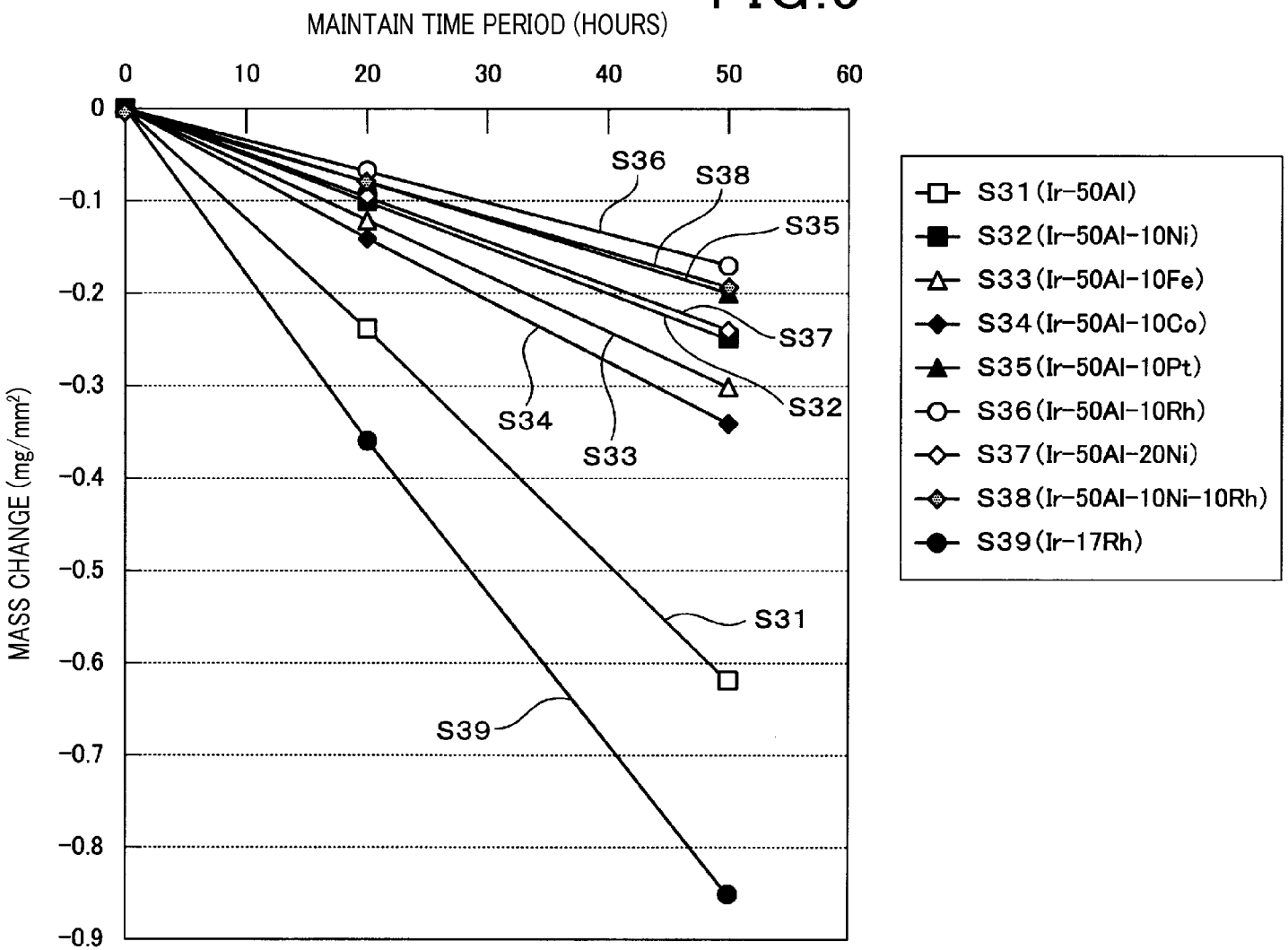
FIG. 5 is a view showing a relationship between a maintain time period and a mass change of each of electrode chips (as test samples S31 to S39) in a high temperature oxidation test according to a fourth exemplary embodiment of the present invention.

FIG. 5 is a view showing a relationship between a maintain time period and a mass change of each of electrode chips (as test samples S31 to S39) in a high temperature oxidation test according to the fourth exemplary embodiment.

The fourth exemplary embodiments prepared test samples S31 to S39, each of which corresponds to an electrode chip having a different composition. A high temperature oxidation test was performed for each of the test samples S31 to S39 in order to evaluate the oxidation resistance of each of the test samples S31 to S39.

For example, the electrode chip of the test sample S31 corresponds to the electrode chip 4 in the spark plug 1 according to the first exemplary embodiment previously described, the electrode chip of the test sample S31 has the same composition of the test sample S3 used in the third exemplary embodiment. That is, the test sample S31 has the composition of 50 mol % of aluminum and iridium as a remainder thereof. In FIG. 5, the test sample S31 is designated with "S31 (Ir-50Al)".

The electrode chip of each of the test samples S32, S33, S34, S35, S36, S37 and S38 corresponds to the electrode chip in the spark plug according to the second exemplary embodiment previously described. That is, the electrode chips of the test samples S32, S33, S34, S35, S36, S37 and S38 have the same composition of the electrode chips of the spark plugs of the test samples S7, S8, S16, S17, s11, S14 and S19, respectively as shown in Table 1.

In addition, the electrode chip of the test sample S39 is a comparison sample having a composition of 17 mol % of rhodium Rh and iridium as a remainder thereof.

A description will now be given of the high temperature oxidation test. First, each of the test samples S31 to S39 (electrode chips) was placed in an electric furnace. Each of the test samples S31 to S39 was maintained at 1200° C. and over 50 hours under the atmosphere environment in the electric furnace. A mass (mg) of each of the test sample S31 to S39 was detected every time when 20 hours was elapsed and time when 50 hours was elapsed. A mass change c (mg/mm$^2$) of each of the test samples S31 to S39 was calculated.

The mass change c (mg/mm$^2$) was calculated by using the following equation:

$$c=(a2-a1)/b,$$

where a1 (mg) is a mass of the electrode chip before the high temperature oxidation test, a2 (mg) is a mass of the electrode chip after the high temperature oxidation test, and b (mm$^2$) is a surface area of the electrode chip before the high temperature oxidation test.

The surface area b (mm$^2$) of the electrode chip was calculated on the basis of a size of the electrode chip.

FIG. 5 shows the evaluation results of the test samples S31 to S39. FIG. 5 shows the relationship between the maintain time period of the electrode chip and the mass change c (mg/mm$^2$) of the electrode chip.

As can be understood from the evaluation result shown in FIG. 5, each of the test samples S31 to S38 has a small mass change when compared with the mass change of the test sample S39. In particular, each of the electrode chips corresponds to the test samples S32 to S38 has the mass change further smaller than the mass change of the test sample S39.

As a result, the electrode chip (which corresponds to the test sample S31) in the spark plug according to the first exemplary embodiment has a superior oxidation resistance.

Further, the electrode chip (which corresponds to each of the test samples S32 to S38) in the spark plug according to the second exemplary embodiment has a more superior oxidation resistance.

(Structural Modifications)

Figure 6:
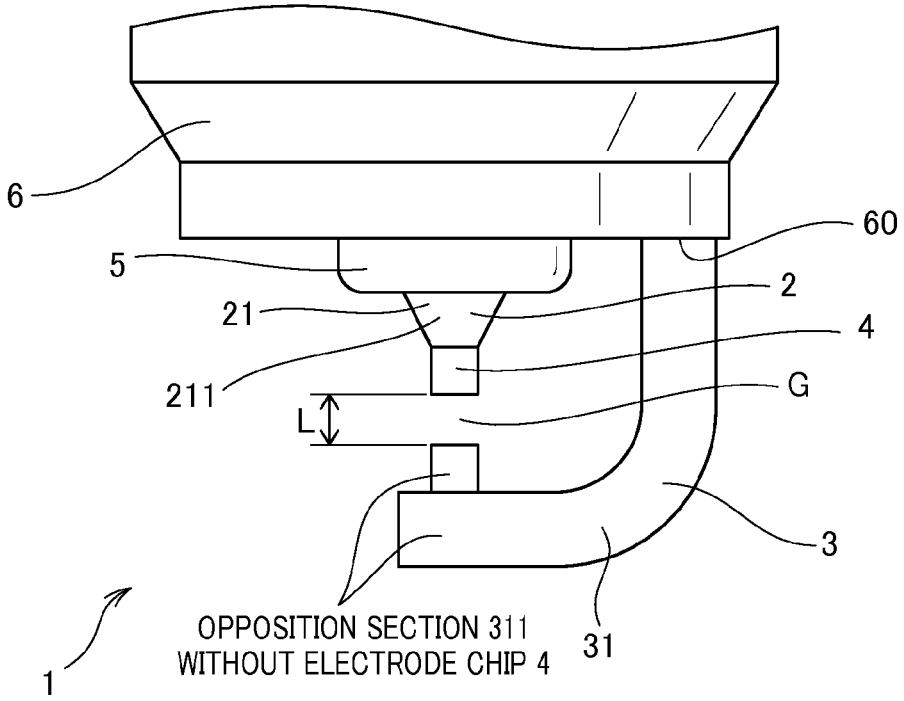
FIG. 6 is a view showing a modification of the spark plug having the electrode chip formed on the center electrode only.
Figure 7:
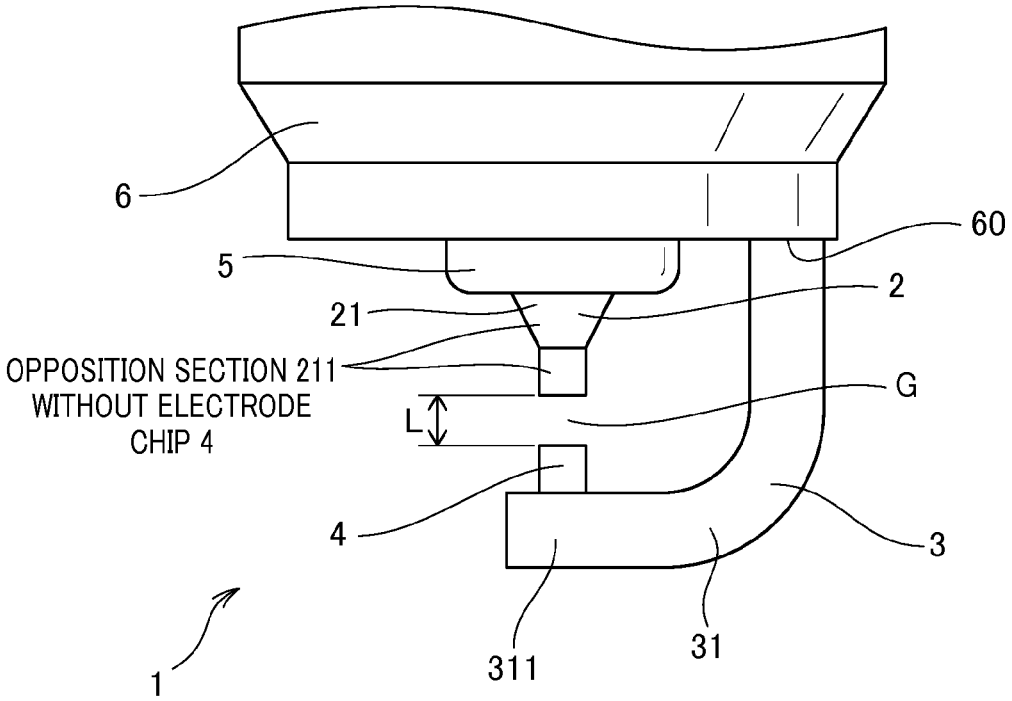
FIG. 7 is a view showing another modification of the spark plug having the electrode chip formed on the earth electrode only.

The spark plug 1 according to the first and second exemplary embodiments as previously described is comprised of the electrode chips formed on both the center electrode 2 and the earth electrode 3, as shown in FIG. 1 and FIG. 2. However, the concept of the present invention is not limited by the structure of the spark plug 1 according to the first and second exemplary embodiments. For example, it is possible to form the electrode chip 4 on the center electrode 2 or the earth electrode 3. FIG. 6 is a view showing a modification of the spark plug 1 having the electrode chip 4 which is formed on the center electrode 2 only. FIG. 7 is a view showing another modification of the spark plug 1 having the electrode chip 4 which is formed on the earth electrode 3 only. It is possible for the spark plug 1 shown in FIG. 6 and FIG. 7 to have the same actions and effects of the spark plug 1 according to the first and second exemplary embodiments shown in FIG. 1 and FIG. 2.

While specific embodiments of the present invention have been described in detail, it will be appreciated by those skilled in the art that various modifications and alternatives to those details could be developed in light of the overall teachings of the disclosure. Accordingly, the particular arrangements disclosed are meant to be illustrative only and not limited to the scope of the present invention which is to be given the full breadth of the following claims and all equivalents thereof.

What is claimed is:

1. A spark plug comprising:

a center electrode; and an earth electrode which is arranged faced to the center electrode so that a spark discharging gap is formed between the center electrode and the earth electrode, wherein an electrode chip is formed on at least one of the center electrode and the earth electrode, and the electrode chip comprises 40 to 60 mol % of aluminum, and iridium as a remainder thereof, to make an iridium-aluminum alloy, and wherein an intermetallic compound of iridium-aluminum is contained as a main phase in the iridium-aluminum alloy.

2. The spark plug according to claim 1, wherein the electrode chip further comprises 1 to 20 mol % of at least one metal selected from nickel, iron, cobalt, platinum and rhodium, which replaces part of the iridium.

3. The spark plug according to claim 2, wherein the electrode chip comprises at least one metal selected from nickel and rhodium which replaces part of the iridium.

4. The spark plug according to claim 1, wherein the electrode chip is formed on the center electrode.

5. The spark plug according to claim 2, wherein the electrode chip is formed on the center electrode.

6. The spark plug according to claim 3, wherein the electrode chip is formed on the center electrode.

7. The spark plug according to claim 1, wherein the electrode chip is formed on the earth electrode.

8. The spark plug according to claim 2, wherein the electrode chip is formed on the earth electrode.

9. The spark plug according to claim 3, wherein the electrode chip is formed on the earth electrode.

10. The spark plug according to claim 1, wherein the electrode chip further contains not more than approximately 0.5 mol % of a total of silicon and zinc as incidental impurity.

11. The spark plug according to claim 2, wherein the electrode chip further contains not more than approximately 0.5 mol % of a total of silicon and zinc as incidental impurity.

12. The spark plug according to claim 3, wherein the electrode chip further contains not more than approximately 0.5 mol % of a total of silicon and zinc as incidental impurity.

* * * * *